US010405656B1

(12) United States Patent
Lawrence

(10) Patent No.: US 10,405,656 B1
(45) Date of Patent: Sep. 10, 2019

(54) DRAWER SLIDING MECHANISM

(71) Applicant: Larry M. Lawrence, Acampo, CA (US)

(72) Inventor: Larry M. Lawrence, Acampo, CA (US)

( * ) Notice: Subject to any disclaimer, the term of this patent is extended or adjusted under 35 U.S.C. 154(b) by 0 days.

(21) Appl. No.: 16/143,713

(22) Filed: Sep. 27, 2018

(51) Int. Cl.
*A47B 88/90* (2017.01)
*A47B 88/975* (2017.01)
*A47B 88/40* (2017.01)

(52) U.S. Cl.
CPC ..... *A47B 88/90* (2017.01); *A47B 88/40* (2017.01); *A47B 88/975* (2017.01); *A47B 2088/901* (2017.01)

(58) Field of Classification Search
CPC ..... A47B 88/90; A47B 88/40; A47B 88/969; A47B 88/975; A47B 88/60; A47B 2088/901
See application file for complete search history.

(56) References Cited

U.S. PATENT DOCUMENTS

| | | | | |
|---|---|---|---|---|
| 7,770,986 | B1 | 8/2010 | Simaitis | |
| 9,895,046 | B1 * | 2/2018 | Wilson | A47L 15/506 |
| 2004/0244825 | A1 * | 12/2004 | Ashton | A47L 15/506 134/85 |
| 2017/0135554 | A1 * | 5/2017 | Park | A47L 15/16 |

* cited by examiner

*Primary Examiner* — Daniel J Rohrhoff
(74) *Attorney, Agent, or Firm* — Sanchelima & Associates, P.A.; Christian Sanchelima; Jesus Sanchelima

(57) ABSTRACT

A drawer sliding mechanism for storing materials is disclosed. The drawer sliding mechanism comprises a cabinet. The cabinet comprising a table top and side walls. The drawer sliding mechanism further comprises rails coupled to the cabinet. The rails comprise at least one bracket. The bracket is tilted about an angle. The drawer sliding mechanism further comprises a drawer coupled to rails. The drawer is slid horizontally along the rails and the drawer is raised vertically by tilting the at least one bracket. The drawer is placed on the table top by sliding the drawer when the at least one bracket is raised.

8 Claims, 10 Drawing Sheets

DRAWER SLIDING MECHANISM

BACKGROUND OF THE INVENTION

1. Field of the Invention

The present disclosure generally relates to cabinets. More particularly, the present disclosure generally relates to a drawer provided in a cabinet, in which the drawer can be slid horizontally and raised vertically to access materials stored in the drawer.

2. Description of the Related Art

It is very well known that cabinets are used to store materials such as household items, small parts, face creams, hair products, kitchen items, business papers, tools and so on. In order to store more materials, the cabinet may be partitioned into different compartments. Each compartment may be provided with a drawer, which is provided in a box-like storage compartment to store the materials.

Typically, the drawer comprises two or three piece slides with one of the slides being attached to the drawer and another of the slides being attached to the inside of the cabinet. Further, the drawer may comprise rollers to facilitate in smooth operation of sliding the drawer from open to close position or vice versa. Since drawers can be shaped to any size and number, it becomes difficult to access the materials placed in the drawer. For example, if a user of the cabinet needs to access a material stored in the drawer at the bottom of the cabinet, then it becomes difficult for the user to bend, slide the bottom drawer and access the material. Further, bending and accessing each drawer may consume time.

In order to solve the problems of accessing materials in drawers that are placed at bottom or top (overhead) of the cabinets, several solutions have been proposed in the past. One such solution is disclosed in U.S. Pat. No. 7,770,986. In U.S. Pat. No. 7,770,986, a pivot assembly that can be inserted into kitchen cabinets that is placed at overhead spaces disclosed. The pivot assembly is coupled to a drawer. The drawer slides out of the cabinet on a pair of drawer slides and rotates down and out 180 degrees on pivot arms, from an up position to a down position. The arrangement allows the drawer to remains stable when the drawer is coming down.

However, the above design has certain problems. The design can only be implemented for overhead cabinets. Further, the materials stored in the drawer may have stacked up on top of each other or one in back of another. This may result in a situation where the materials may fall on the user leading to an injury.

Other documents describing the closest subject matter provide for a number of more or less complicated features that fail to solve the problem in an efficient and economical way. None of the patents suggest the novel features of the present invention.

Therefore, there is a need for a drawer that can be used to access the materials without much difficulty and remove the clutter that is involved in accessing the materials.

SUMMARY OF THE INVENTION

It is one of the main objects of the present invention to provide a drawer sliding mechanism that avoids the drawbacks of the prior art.

It is one object of the present invention to provide a drawer sliding mechanism for storing materials that facilitates in accessing the materials with ease.

It is another object to provide a drawer sliding mechanism comprising a drawer that can be opened fully and lifted vertically to place on top of a cabinet. A user of the cabinet accesses materials stored in the drawer without bending.

It is another object to provide a drawer sliding mechanism comprising at least one bracket coupled to rails provided in a cabinet. The at least one bracket is coupled to a drawer. The at least one bracket is raised or tilted about an angle e.g., 45 degrees to lift the drawer in vertical position.

It is another object to provide a drawer sliding mechanism that is easy to operate and clean the drawer.

It is another object to provide a drawer sliding mechanism that can be attached to an existing cabinet or to a new cabinet for ease of use and access to materials stored in the drawer.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
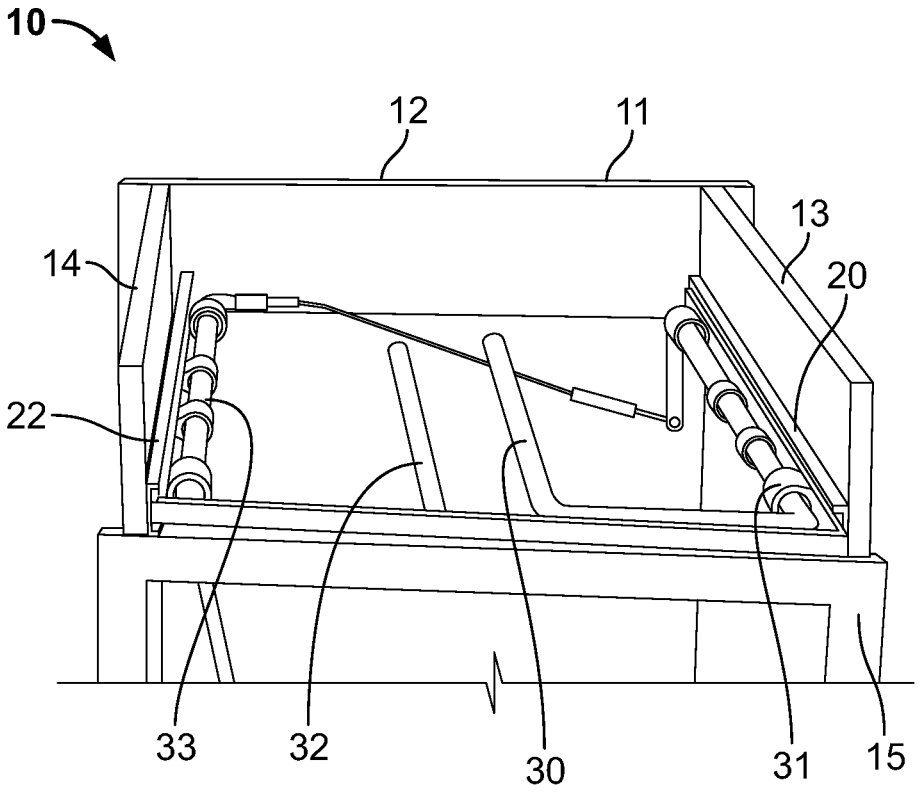
FIG. 1 illustrates a perspective view a drawer sliding mechanism including brackets, in accordance with one embodiment of the present disclosure.

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a drawer sliding mechanism for storing materials. The drawer sliding mechanism comprises a cabinet. The cabinet may include kitchen cabinets, bathroom cabinet, shop drawer and so on. The cabinet comprises a table top and four side walls. The drawer sliding mechanism further comprises rails coupled to the cabinet. The rails comprise at least one bracket. The at least one bracket is tilted about an angle. The drawer sliding mechanism further comprises a drawer coupled to rails. The drawer is slid horizontally along the rails and the drawer is raised vertically by tilting the at least one bracket. The drawer is placed on the table top by sliding the drawer when the at least one bracket is raised.

Various features and embodiments of the drawer sliding mechanism for storing materials are explained in conjunction with the description of FIGS. 1-10.

Referring to FIGS. 1, 2, 3 and 4, constructional features of a drawer sliding mechanism 10 are shown, in accordance with one embodiment of the present disclosure. The drawer sliding mechanism 10 comprises a cabinet 11. The cabinet 11 may include a typical cabinet made up of wood or plastic or any material suitable to withstand the weight of materials intended to store in the cabinet 11. The cabinet 11 may include a kitchen cabinet, office desk drawer, shop drawer and so on for storing the materials. As known, the cabinet 11 comprises a first wall 12, a second wall 13, a third wall 14, and a fourth wall 15. The first wall 12 may indicate a back wall of the cabinet 11. The second wall 13 and the third wall 14 may indicate left hand sidewall and right hand sidewall of the cabinet 11, respectively. The fourth wall 15 may indicate a front wall of the cabinet 11.

Figure 3:
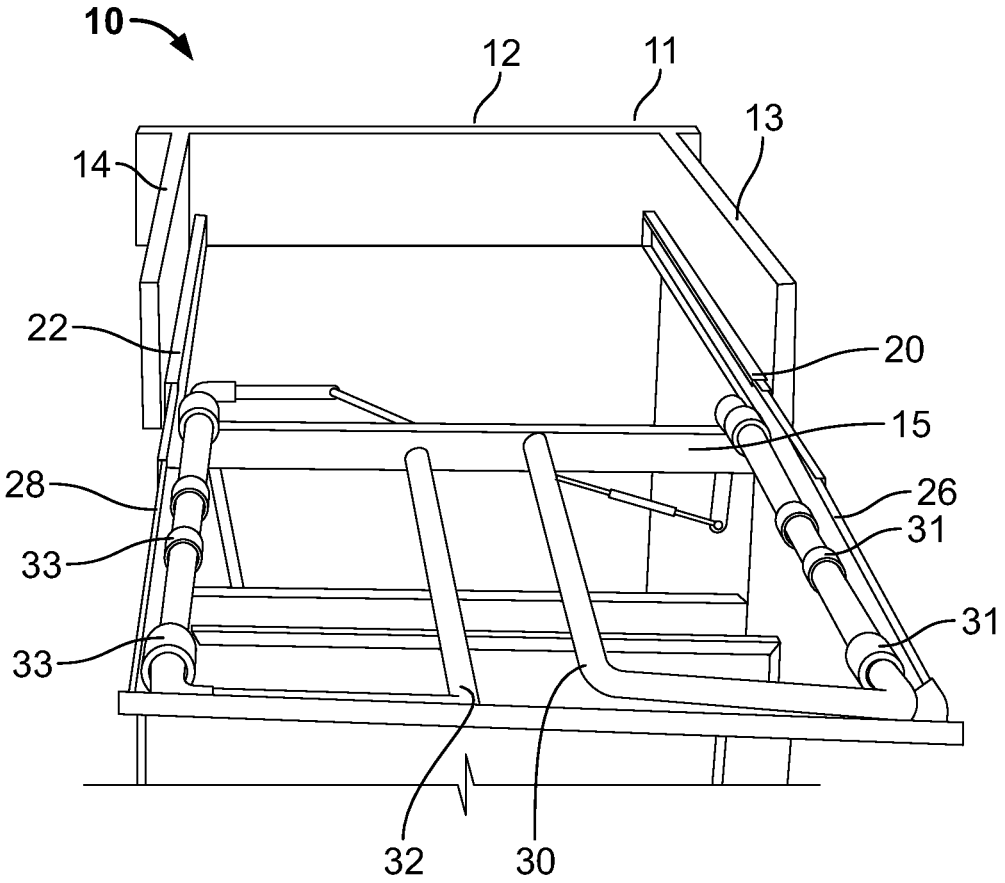
FIG. 3 illustrates the brackets slid away from a cabinet, in accordance with one embodiment of the present disclosure.

At inner surface of the second wall 13, a first rail 20 is provided as shown in FIGS. 1 and 3. Similarly, at inner surface of the third wall 14, a second rail 22 is provided. The first rail 20 comprises a first slider 26. Similarly, the second rail 22 comprises a second slider 28. Further, the first slider 26 comprises a first bracket 30. The first bracket 30 may be provided in substantial U-shape or V-shape or C-shape, or in L-shape. The first bracket 30 is coupled to the first slider 26 using hinges 31. In one example, the first bracket 30 may be coupled to the first slider 26 using any known mechanisms used to connect mechanical components such as welding, screw and so on. Similarly, the second slider 28 comprises a second bracket 32. The second bracket 32 may be provided in substantial U-shape or V-shape or C-shape or in L-shape position. The second bracket 32 is coupled to the second slider 28 using hinges 33. In one example, the second bracket 32 may be coupled to the second slider 28 using any known mechanisms used to connect mechanical components such as welding, screw and so on.

Although the present disclosure is explained to include two brackets i.e., first bracket 30 and the second bracket 32, it is obvious to a person skilled in the art to implement the present disclosure with the help of a single bracket or more than two brackets provided in U-shape or V-shape or C-shape, or L-shape.

Figure 2:
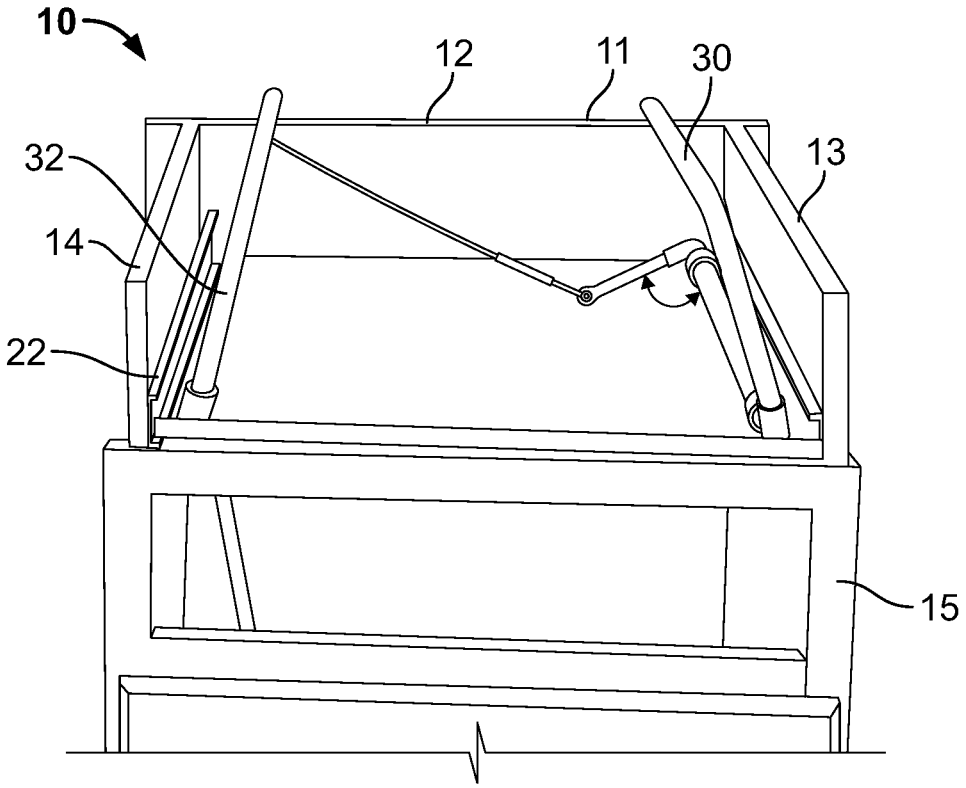
FIG. 2 illustrates the brackets in raised position, in accordance with one embodiment of the present disclosure.
Figure 4:
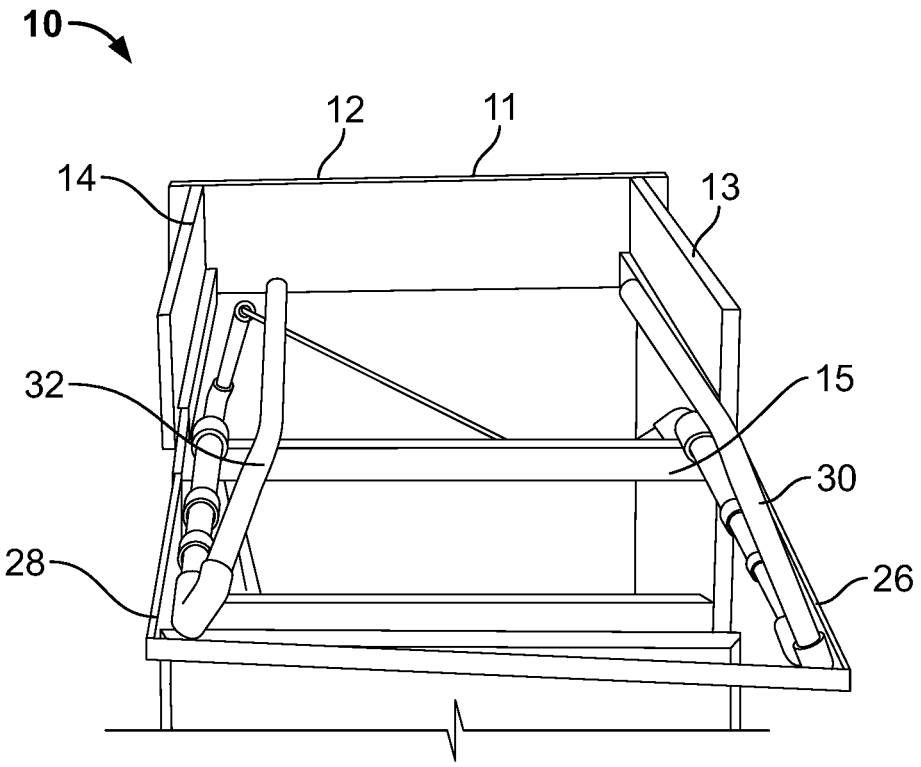
FIG. 4 illustrates the brackets slid away from the cabinet and raised, in accordance with one embodiment of the present disclosure.

In one implementation, the first bracket 30 and the second bracket 32 may be raised at an angle, as shown in FIGS. 2 and 4. For example, one side of the first bracket 30 and the second bracket 32 may be raised by an angle of 45 degrees with respect to their respective opposite sides. It should be noted that the hinges 31 facilitate in raising or tilting of the first bracket 30. Similarly, the hinges 33 facilitate in raising or tilting of the second bracket 32.

Referring to FIG. 1, original position of the drawer sliding mechanism 10 is shown. From its original position, the first slider 26 and the second slider 28 may be pulled away by sliding along the first rail 20 and the second rail 22, respectively, as shown in FIG. 3. The first slider 26 and the second slider 28 are pulled away from the first wall 12 such that the first bracket 30 and the second bracket 32 are also pulled. After sliding or pulling, the first bracket 30 and the second bracket 32 may be raised at angle e.g., 45 degrees, as shown in FIG. 4. Subsequently, the first slider 26 and the second slider 28 may be pushed along the first rail 20 and the second rail 22, respectively. The first slider 26 and the second slider 28 are pushed towards the first wall 12 in raised position, as shown in FIG. 2.

In order to retrieve from raised position shown in FIG. 2 to its original position shown in FIG. 1, at first, the first bracket 30 and the second bracket 32 are pulled away from the first wall 12 in raised position. In order words, the first bracket 30 and the second bracket 32 are pulled to the position shown in FIG. 4 from the position shown in FIG. 2. Subsequently, the first bracket 30 and the second bracket 32 are lowered to the position shown in FIG. 3. Further, the first bracket 30 and the second bracket 32 are pushed towards the first wall 12 along the first rail 20 and the second rail 22, respectively to its original position shown in FIG. 1.

Figure 5A:
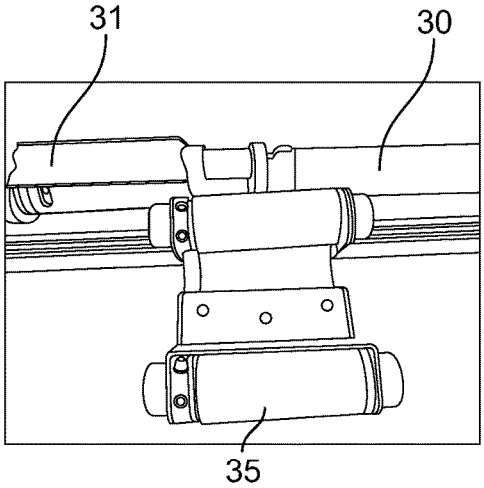
FIG. 5A illustrates the bracket having a hinge attachment, in accordance with one embodiment of the present disclosure.
Figure 5B:
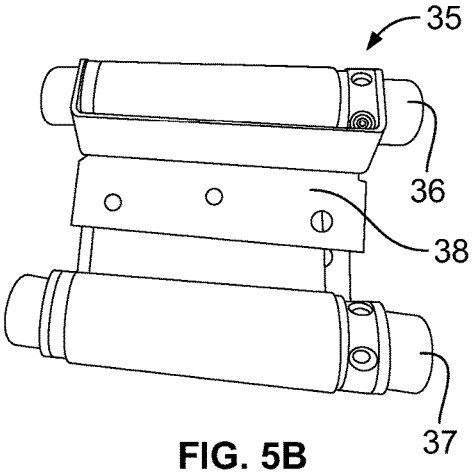
FIGS. 5B and 5C illustrate the hinge attachment, in accordance with one embodiment of the present disclosure.
Figure 5C:
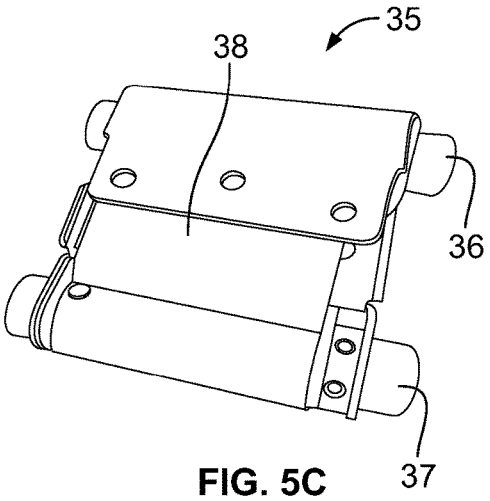

In one embodiment, the bracket e.g., the first bracket 30 may be provided with a hinge attachment 35, as shown in FIG. 5A. The hinge attachment 35 is coupled to the first bracket 30 using know mechanisms such as welding, adhesive and so on. The hinge attachment 35 is used to raise the first bracket 30 at an angle as shown in FIG. 1 and FIG. 2. The hinge attachment 35 comprises a first part 36 and a second part 37 coupled via a support structure 38. The first part 36 and a second part 37 may be provided in a cylindrical structure as shown in FIG. 5B and FIG. 5C. Specifically, FIG. 5B shows a perspective view of the hinge attachment 35. FIG. 5C shows a bottom perspective view of the hinge attachment 35. The support structure 38 may be provided as a hinge in U-shape. The support structure 38 may swivel at an angle, between 0 to 90 degrees.

The first part 36 may be coupled to the first bracket 30 and the second part 37 may be coupled to the first slider 26. The hinge attachment 35 having the support structure 38 may be used to provide support for the first bracket 30 and the first slider 26.

Figure 6:
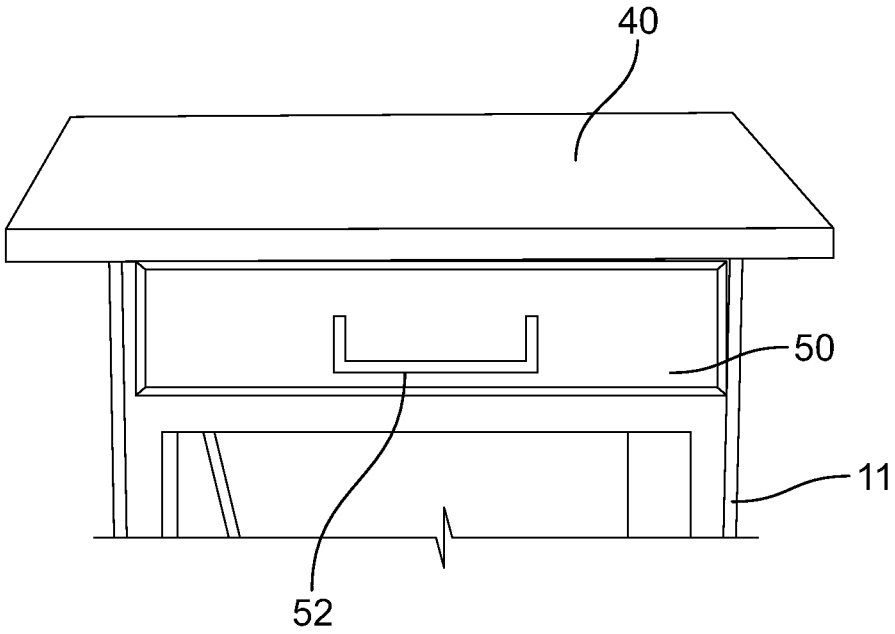
FIG. 6 illustrates the cabinet comprising a drawer, in accordance with one embodiment of the present disclosure.

Referring to FIGS. 6, 7A, 7B, 7C, 8, 9 and 10 operation of the drawer sliding mechanism 10 to facilitate easy access to contents stored in a drawer is explained in conjunction with FIGS. 1, 2, 3 and 4. Referring to FIG. 6, the cabinet 11 comprising a table top 40 is shown. The table top 40 may include a wooden plank or plastic or a metal sheet used to cover the top portion of the cabinet 11. As known, the cabinet 11 may comprise one or more drawers 50 to store materials. The drawer 50 may comprise a handle 52 to operate the drawer 50.

Figure 7A:
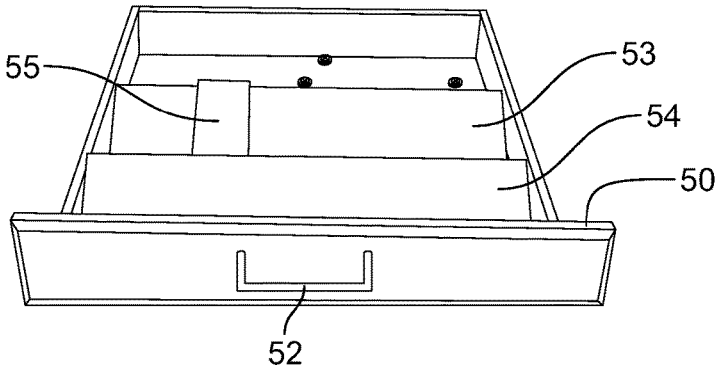
FIGS. 7A, 7B and 7C illustrate the drawer, in accordance with one embodiment of the present disclosure.
Figure 7B:
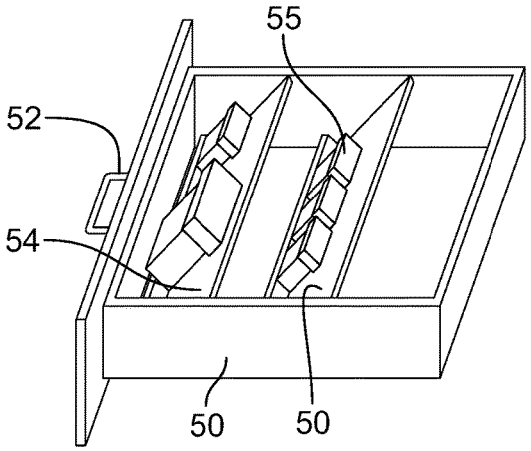
Figure 7C:
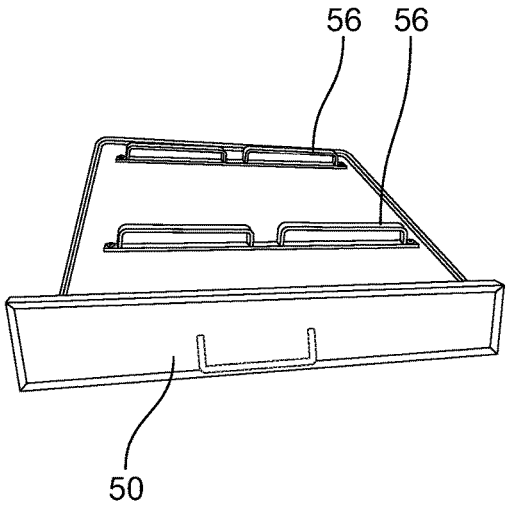

Referring to FIGS. 7A, 7B, and 7C, a perspective view, a side view and a bottom view, respectively of the drawer 50 is shown. The drawer 50 may comprise a box-like structure. In other words, the drawer 50 may include a bottom (not shown), upstanding sidewalls (not shown) from the bottom. The bottom and the sidewalls define an interior and an open top. In one example, the drawer 50 may be separated using one or more separators i.e., a first separator 53, a second separator 54 and so on. The first separator 53 and the second separator 54 may be placed at right angle with respect to bottom surface of the drawer 50. In another example, the first separator 53 and the second separator 54 may be placed at angle with the help of hinges (not shown). The first separator 53 and the second separator 54 may be used to store materials 55 such as, face creams, hand lotions, shavers, hair products, tools and so on. Further, the drawer 50 may be provided with at least one support frame 56 at the bottom, as shown in FIG. 7C. The at least one support frame 56 provided at the bottom is used to couple the drawer 50 to the first bracket 30 and the second bracket 32.

Referring to FIG. 6 in conjunction with FIG. 1, the drawer 50 is placed on the first bracket 30 and the second bracket 32. In one example, the drawer 50 is coupled to the first bracket 30 and the second bracket using a fastener or welding. In another example, the drawer 50 is may be removably coupled to the first bracket 30 and the second bracket 32.

Figure 8:
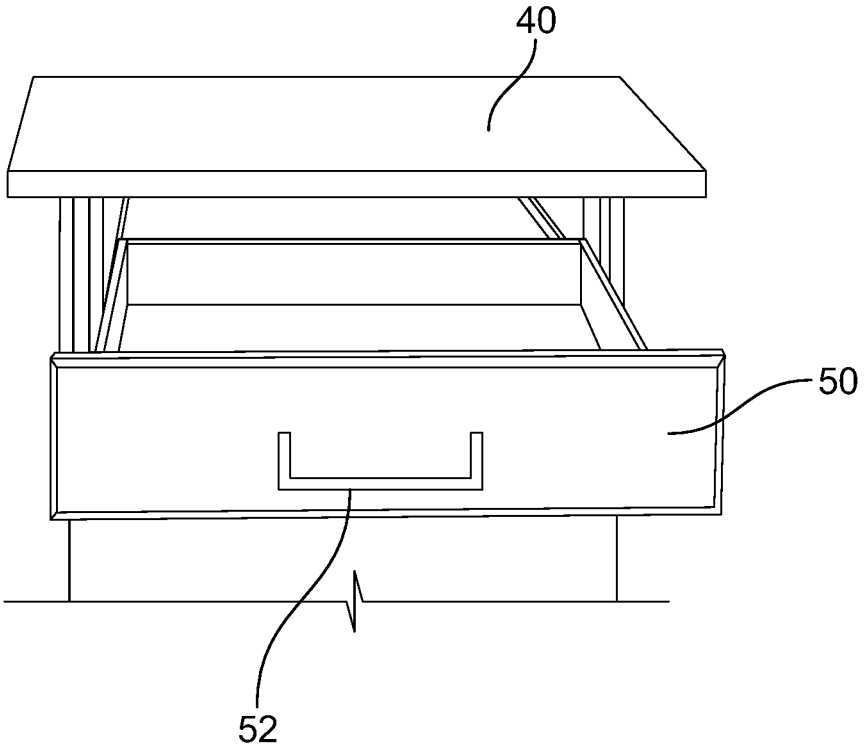
FIG. 8 illustrates the drawer pulled away from the cabinet, in accordance with one embodiment of the present disclosure.
Figure 9:
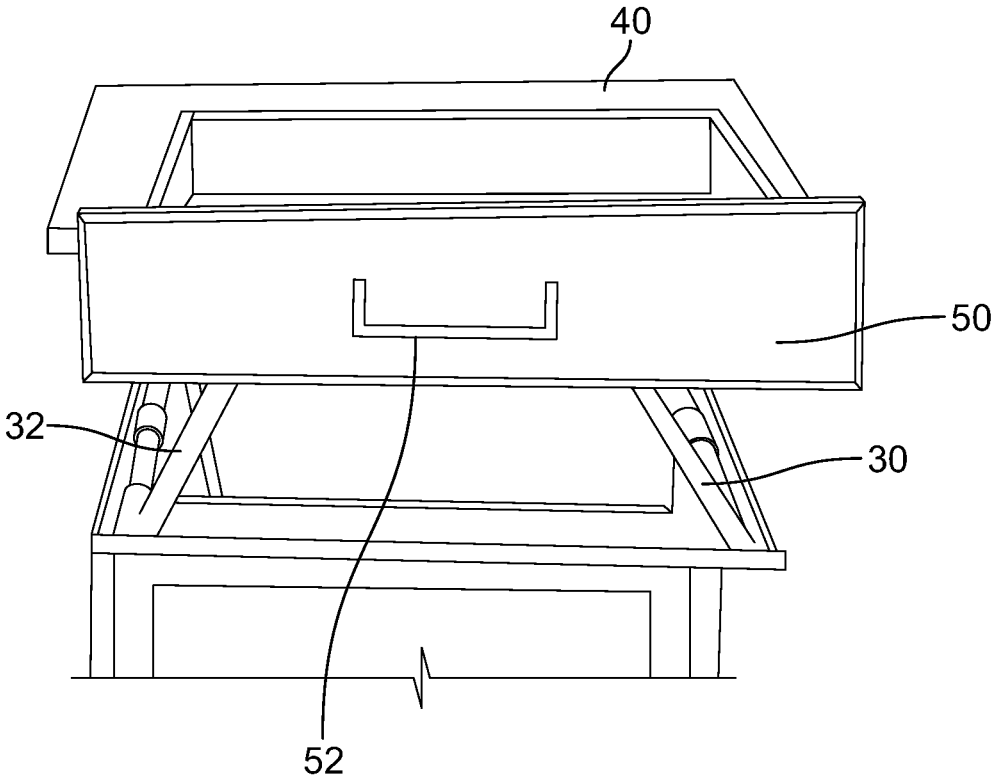
FIG. 9 illustrates the drawer pulled away from the cabinet and raised in vertical position, in accordance with one embodiment of the present disclosure.

In order to access the materials 55 stored in the drawer 50, a user may draw or pull the drawer 50 using the handle 52. Upon pulling, the drawer 50 engages the first bracket 30 and the second bracket 32, and the drawer 50 is pulled away in horizontal direction from the first wall 12, as shown in FIG. 8 (similar to position shown in FIG. 3). In other words, the drawer 50 is pulled in horizontal position with respect to the cabinet 11.

Subsequently, the drawer 50 is raised in vertical position with respect to the cabinet 11. In order to lift the drawer 50 in vertical direction, the drawer 50 is pulled up. Now referring to FIG. 9, in conjunction with FIG. 4, lifting of the drawer 50 is shown. As explained above, the first bracket 30 and the second bracket 32 are raised so that the bottom surface of the drawer 50 comes above the table top 40.

Figure 10:
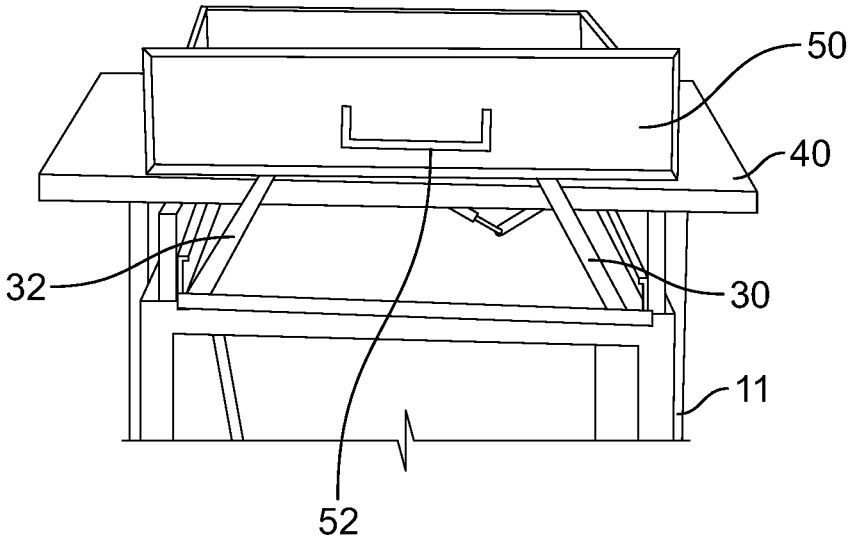
FIG. 10 illustrates the drawer placed on top of the cabinet, in accordance with one embodiment of the present disclosure.

Further, the drawer 50 is pushed towards the first wall 12 in raised position. Referring to FIG. 10, in conjunction with FIG. 2, the drawer 50 pushed towards the first wall 12 in raised position is shown. As the first bracket 30 and the second bracket 32 comprise space therebetween when raised, the space allows the first bracket 30 and the second bracket 32 to go through the table top 40. After reaching the first wall 12, the drawer 50 is placed on the table top 40.

Upon placing the drawer 50 on the table top 40, the user of the cabinet 11 may access the materials 55 stored in the drawer 50. As specified above, the drawer 50 may comprise the first separator 53 and the second separator 54. The user may move the first separator 53 and the second separator 54 to put new materials or to remove materials stored in the drawer 50.

After use, the user may retract the drawer 50 by pulling away from the first wall 12. In order to retract, at first, the user may pull the drawer 50 using the handle 52 to the position shown in FIG. 9. Subsequently, the user may push down the drawer 50 to the position shown in FIG. 8. As discussed above, when the drawer 50 is pushed down, the first bracket 30 and the second bracket 32 are lowered as shown in FIG. 3. Further, the drawer 50 is pushed towards the first wall 12 to the position shown in FIG. 6.

It should be understood that drawer-sliding mechanism may be provided as an attachment to an existing cabinet or can be fixed to a new cabinet. For instance, the cabinet may include a kitchen cabinet, office desk drawer, shop drawer and so on that utilizes the drawer for storing the materials. The user may simply hold the drawer using the handle to fully open the drawer and lift the drawer and again push the drawer on top of the table top. After pushing the drawer on top of the table top, the user may place the drawer on the table top and access the materials. Using the drawer sliding mechanism, the user may not have to bend and struggle to access the materials stored in the drawer. The user may simply place the drawer on the table top to pick or place materials. In one example, the rails may be provided with rollers to facilitate in smooth operation of sliding the drawer from open to close position or vice versa.

The above disclosure facilitates in clutter free usage of the drawers. Further, the user may organize the materials in order without much hassle. Furthermore, the user may access the materials in the draw without having to bend down.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A drawer sliding mechanism, comprising:

a cabinet comprising a table top and side walls;

at least one rail coupled to the cabinet at an inner side, wherein the rail comprises a slider coupled to at least one bracket, and wherein the at least one bracket is tiltable about an angle;

a drawer placed on the at least one bracket, such that the drawer is placed in the cabinet, wherein the drawer is slid horizontally along the rails and away from the cabinet, wherein the drawer is raised by tilting the at least one bracket, and wherein the drawer is slid horizontally towards the cabinet keeping the at least one bracket in raised position, and wherein the drawer placed on the table top to access contents in the drawer.

2. The drawer sliding mechanism of claim 1, wherein the bracket is provided in a U-shape or V-shape or C-shape, or in L-shape structure.

3. The drawer sliding mechanism of claim 1, wherein the bracket is tiltable at an angle of 90 degrees.

4. The drawer sliding mechanism of claim 1, wherein the drawer is slid horizontally away from the cabinet while keeping the at least one bracket in raised position, wherein the at least one bracket is lowered, and the drawer is slid towards the cabinet to place the drawer in the cabinet to close the drawer.

5. The drawer sliding mechanism of claim 1, wherein the at least one bracket is coupled to the slider via a hinge attachment, wherein the hinge attachment facilitates tilting of the at least one bracket.

6. The drawer sliding mechanism of claim 5, wherein the hinge attachment comprises a first part and a second part coupled via a support structure to facilitate tilting of the hinge attachment and to support the bracket to the slider.

7. The drawer sliding mechanism of claim 1, wherein the drawer comprises a support frame at the bottom, wherein the support frame is used to couple the drawer to the at least one bracket.

8. A drawer sliding mechanism, comprising:

a cabinet comprising a table top and side walls;

at least one rail coupled to the cabinet at an inner side, wherein the rail comprises a slider coupled to at least one bracket, and wherein the at least one bracket is tiltable about an angle;

a drawer placed on the at least one bracket, such that the drawer is placed in the cabinet, in order to access contents in the drawer, the drawer is slid horizontally along the rails and away from the cabinet, wherein the drawer is raised by tilting the at least one bracket, and wherein the drawer is slid horizontally towards the cabinet keeping the at least one bracket in raised position, and wherein the drawer placed on the table top, wherein the drawer is slid horizontally away from the cabinet while keeping the at least one bracket in raised position, wherein the at least one bracket is lowered, and the drawer is slid towards the cabinet to place the drawer in the cabinet to close the drawer.

* * * * *